US008430340B2

(12) United States Patent
Herre et al.

(10) Patent No.: US 8,430,340 B2
(45) Date of Patent: Apr. 30, 2013

(54) ROTARY ATOMIZER COMPONENT

(75) Inventors: Frank Herre, Oberriexingen (DE); Peter Marquardt, Steinheim (DE); Hans-Jurgen Nolte, Besigheim (DE); Michael Baumann, Flein (DE); Bernhard Seiz, Lauffen (DE)

(73) Assignee: Dürr Systems Inc., Auburn Hills, MI (US)

( * ) Notice: Subject to any disclaimer, the term of this patent is extended or adjusted under 35 U.S.C. 154(b) by 538 days.

(21) Appl. No.: 12/624,174

(22) Filed: Nov. 23, 2009

(65) Prior Publication Data

US 2010/0143599 A1 Jun. 10, 2010

Related U.S. Application Data

(62) Division of application No. 11/397,198, filed on Apr. 4, 2006, now abandoned.

(30) Foreign Application Priority Data

Apr. 5, 2005 (DE) ..... 10 2005 015 604
Sep. 15, 2005 (DE) ..... 10 2005 044 158

(51) Int. Cl.
*B05B 3/00* (2006.01)

(52) U.S. Cl.
USPC ..... 239/225.1; 239/240; 239/7

(58) Field of Classification Search ..... 239/225.1, 239/223, 237, 240, 246, 261, 600, DIG. 14, 239/251, 7, 11
See application file for complete search history.

(56) References Cited

U.S. PATENT DOCUMENTS

| | | | |
|---|---|---|---|
| 2,889,873 | A | 6/1959 | Sauter |
| 3,594,124 | A | 7/1971 | Beni |
| 4,214,708 | A | 7/1980 | Lacchia |
| 4,275,838 | A | 6/1981 | Fangmeyer |

(Continued)

FOREIGN PATENT DOCUMENTS

| | | |
|---|---|---|
| DE | 898 413 | 11/1953 |
| DE | 2005015 A1 | 9/1970 |

(Continued)

OTHER PUBLICATIONS

German Search Report, Dec. 3, 2010.

*Primary Examiner* — Davis Hwu
(74) *Attorney, Agent, or Firm* — Bejin, VanOphem & Bieneman PLC

(57) ABSTRACT

A rotary atomizer component, such as for a steering air ring or bell cup for a rotary atomizer with at least one steering air jet for delivering steering air (or controlled air) and a rotary bearing shaft where, in axial direction between the bell cup and the steering air jet, a circumferential annular gap is located. A shaft cover in form of a bushing covers the bearing shaft, when mounted, at least partially in the annular gap area between the bell cup and the steering air jet. In addition, the annular gap space between the front surface of the bearing unit and the internal surface facing it axially or any other front element of the atomizer is sealed in a radial way internally against the externally accessible area of the shaft. The sealing element provided for this purpose is located along the internal circumference of the air-steering rings or front element and able to be attached to the front surface of the bearing unit in a way that it is elastically deformable.

20 Claims, 10 Drawing Sheets

U.S. PATENT DOCUMENTS

| | | | | |
|---|---|---|---|---|
| 4,337,895 | A | 7/1982 | Gallen | |
| 4,384,682 | A | 5/1983 | Sugiyama et al. | |
| 4,447,008 | A | 5/1984 | Allen | |
| 4,505,430 | A | 3/1985 | Rodgers et al. | |
| 4,521,462 | A | 6/1985 | Smythe | |
| 4,555,058 | A | 11/1985 | Weinstein et al. | |
| 4,589,597 | A | 5/1986 | Robisch et al. | |
| 4,896,834 | A | 1/1990 | Coeling et al. | |
| 6,105,886 | A | 8/2000 | Hollstein et al. | |
| 6,569,258 | B2 | 5/2003 | Clifford et al. | |
| 7,080,794 | B2 * | 7/2006 | Baumann et al. | 239/223 |

FOREIGN PATENT DOCUMENTS

| | | | |
|---|---|---|---|
| DE | G 94 19 641.9 | | 3/1995 |
| DE | 43 35 507 | | 4/1995 |
| EP | 0 33 040 | A1 | 8/1981 |
| EP | 0120648 | A2 | 10/1984 |
| EP | 0 780 159 | | 6/1997 |
| EP | 1 114 677 | A1 | 7/2001 |
| EP | 1367302 | A2 | 12/2003 |
| GB | 2 163675 | A | 8/1985 |

* cited by examiner

ROTARY ATOMIZER COMPONENT

This application claims priority to U.S. Ser. No. 11/397,198 filed Apr. 4, 2006 and hereby incorporates by reference all of said application in its entirety.

TECHNICAL FIELD

The present invention relates to a rotary atomizer component, such as for a steering air ring or bell cup for a rotary atomizer with at least one steering air jet for delivering steering air (or controlled air) and a rotary bearing shaft where, in axial direction between the bell cup and the steering air jet, a circumferential annular gap is located. A shaft cover in form of a bushing covers the bearing shaft, when mounted, at least partially in the annular gap area between the bell cup and the steering air jet. In addition, the annular gap space between the front surface of the bearing unit and the internal surface facing it axially or any other front element of the atomizer is sealed in a radial way internally against the externally accessible area of the shaft. The sealing element provided for this purpose is located along the internal circumference of the air-steering rings or front element and able to be attached to the front surface of the bearing unit in a way that it is elastically deformable.

BACKGROUND OF THE INVENTION

Rotary atomizers are commonly used for coating components, such as automobile body parts, and are known, for example, from German Patent DE 94 19 641 U1. Such rotary atomizers have a pivoted bearing shaft driven by a turbine charged by compressed air and that carries a bell cup that rotates during the coating procedure with a high revolution. The bell cup is supplied with coating material (e. g. paint, varnish, etc.) through an internal paint tube, in which case the coating material is carried to the outside by centrifugal forces and sprayed through a circumferential spraying edge.

Furthermore, it is known to produce a spray stream from the bell cup by using steering air. For this purpose, the known rotary atomizer has an air steering ring on its front with circumferentially distributed air steering jets in an axial direction through which compressed air is blown that forms an air steering stream directed towards the external surface of the bell cup, thus forming the spray stream.

Rotary atomizers are also known in which the air-steering stream is not directed towards the external surface of the bell cup but towards the spray cone itself. Furthermore, it is possible to blow out of the air-steering stream in an oblique direction as to the rotation axis of the bell cup or even in radial direction, in which case, the "Coanda-effect" is taken advantage of, as known, for example, from German Patent DE 100 53 296 C2.

Furthermore it is known from several publications, such as European Patents EP 0 333 040 B1 and EP 1 367 302 A2, how to clean a rotary atomizer by introducing it together with the mounted bell cup into an automatic cleaning apparatus and then to spray it with a cleaning fluid inside the cleaning device.

However, this automatic cleaning procedure is problematic with known rotary atomizers with an air-steering ring as described and with similar atomizers, since the cleaning fluid or the coating material from the previous coating operation can penetrate into the ring-shaped annular gap space between the front facing the bell cup and the bearing unit of the bell cup containing the conventional air turbine (facing axially the internal surface in front of the air-steering ring.) During the subsequent operation of the atomizer for painting, the liquid filled into the annular gap space is blown out by the air exiting the air depot of the atomizer, in which case the object to be coated, e. g., a vehicle body, can be sullied and lead to paint errors. When cleaning the known rotary atomizer previously described the area between the bell cup and the air steering ring had to be left empty to prevent the penetration of cleaning fluid and coating material into the bearing unit. Therefore, automatic cleaning was difficult with known rotary atomizers and only possible within limits.

In German Patent Application DE 10 2005 015 604 a bushing-shaped shaft cover was proposed that covers the bearing shaft in mounted state at least partially in the annular gap area between bell cup and atomizer casing or air-steering ring. This shaft cover in the shape of a bushing prevents the penetration of cleaning fluid into the annular gap during automatic cleaning of the rotary atomizer. By this, penetration of cleaning fluid into the bearing unit can be prevented, which in an extreme case could lead to blockage of the bearing shaft. Since the characteristics and measures of German Patent Application DE 10 2005 015 604 may also be practical for the present invention, its publication is included into the present application by reference. However, even in this proposed solution a small annular gap remains between shaft and bushing-shaped shaft cover, through which the rinsing fluid could penetrate into the annular gap space between bearing unit and internal surface of the air-steering ring.

In German Patent Application No. 10 2005 015 604.5, which is assigned to the assignee of the present invention, there is proposed a steering air ring or bell cup for a rotary atomizer with at least one steering air jet for delivering a steering air stream and a rotary bearing shaft where, in axial direction between the bell cup and the steering air jet, a circumferential annular gap is located. A shaft cover in form of a bushing covers the bearing shaft when mounted at least partially in the annular gap area between the bell cup and the steering air jet.

In German Application No. 10 2005 055 154.8, which is also assigned to the assignee of the present invention, there is proposed a rotary atomizer where the annular gap space between the front surface of the bearing unit and the internal surface facing it axially or any other front element of the atomizer is sealed in a radial way internally against the externally accessible area of the shaft. The sealing element provided for this purpose is located along the internal circumference of the air-steering rings or front element and able to be attached to the front surface of the bearing unit in a way that it is elastically deformable.

BRIEF SUMMARY OF THE INVENTION

It is known that the air steering stream produces a vacuum in the circumferential annular gap between the bell cup and the air steering ring, which can lead to penetration of cleaning fluid during automatic cleaning, if the cleaning fluid is directed directly towards the unprotected annular gap between the bell cup and the air steering ring. When cleaning the known rotary atomizer in an automatic cleaning system, this vacuum in the annular gap between bell cup and air steering ring can lead to cleaning fluid penetrating the annular gap remaining there even after the cleaning procedure, which can lead to disturbing splatters of cleaning fluid.

Therefore, the present invention lowers the vacuum in the ring slot between the bell cup and the air steering ring though adequate constructive measures, thereby counteracting penetration of coating material or cleaning fluid into the ring slot. One embodiment of the present invention provides a shaft cover in the shape of a bushing, which covers—at least partially—the bearing shaft in its mounted state in the area of the annular gap between the bell cup and the casing of the rotary atomizer. This shaft cover in the shape of a bushing prevents the penetration of cleaning fluid into the annular gap during automatic cleaning of the rotary atomizer. Preferably, the diameter of the shaft cover is between the exterior diameter of the bell cup and that of its shaft. Therefore, the invention must be told apart from those known rotary atomizers, in which rigid parts to fit cover partially the bell cup on its external side, so that no annular gap between the bell cup and the rotary atomizer is present at all.

In another embodiment of the present invention the bushing-shaped shaft cover is disposed in radial direction between the external air steering jets and the internal bearing shaft. In a ring-shaped disposition of several air steering jets the bushing-shaped shaft cover is preferably located inside the air steering jet ring, so that the difference in diameters between the bell cup and the air steering jet ring (i.e. the depth of the annular gap is reduced in radial direction). This reduces the danger of penetration of rinsing fluid or dirt is reduced and the location of the shaft cover contributes to reducing the vacuum in the ring slot.

In yet another embodiment of the present invention the rotary atomizer component is an air steering ring into which the bushing-shaped shaft cover is integrated, in which case the bushing-shaped shaft cover is located on the front side of the air steering ring and adjusted coaxially to it. Alternatively, however, there is the option of the bushing-shaped shaft cover to be in an oblique or radial position as to the axis of rotation of the bell cup.

In still another embodiment of the present invention the rotary atomizer component is an atomizer casing with an integrated air steering ring. The air-steering ring and the atomizer casing form in this case one single component.

In a further embodiment of the present invention, the rotary atomizer component is an innovative bell cup, into which the bushing-shaped shaft cover is integrated, in which case the shaft cover is located on the side oriented towards the air steering ring of the bell cup and adjusted coaxially towards the bell cup.

The bushing-shaped shaft cover can be adapted as one piece to the rotary atomizer component according to the invention, what, however, requires a new construction of the rotary atomizer component. Therefore, within the framework of the invention, there also exists the possibility of forming the bushing-shaped shaft cover as a separate component linked mechanically to the rotary atomizer component. For example, the bushing-shaped shaft cover can be pressed into the bore of the air steering ring, which serves as a conduct for the bearing shaft. In this case, the bushing-shaped shaft cover is connected to the air steering ring by means of a pressure connection. Nevertheless, the invention is not limited to a pressure fit as to the mechanical connection of the rotary atomizer component with the bushing-shaped shaft cover, but can be executed by means of other joining procedures. For example, the bushing-shaped shaft cover can be connected to the air steering ring by means of welding, soldering, screws, rivets or glue. When forming the bushing-shaped shaft cover as a separate component, the shaft cover can be made of another material than the air steering ring, making a constructive optimization of both components possible as to their individual technical functions. For example, the shaft cover can be made of plastic.

As already mentioned before, the bushing-shaped shaft cover also has the function of reducing the vacuum in the annular gap between the bell cup and the air steering ring, in order to counteract the penetration of cleaning fluid or coating material into the annular gap. Therefore, the bushing-shaped shaft cover reduces the free depth of the annular gap in radial direction in comparison with a rotary atomizer without such a shaft cover.

Furthermore it must be mentioned that the present invention not only concerns the present innovative rotary atomizer component as described (e. g. bell cup or air steering ring) as a stand-alone or spare part, but also comprehends a complete rotary atomizer with such an innovative rotary atomizer component.

In the case of such a rotary atomizer according to the present invention the bell cup can make an external rinse possible, as known already from the aforementioned publication DE 94 19 641 U1, so that the contents thereof as to the constructive design of the bell cup and the rotary atomizer of the present description is accountable to its fullest extent. Therefore an external rinse channel may be provided with the rotary atomizer according to the invention for external rinsing of the bell cup that runs inside the bell cup and ends in a circumferential annular gap disposed at the front of the bell cup towards the side of the air steering ring. The bushing-shaped shaft cover is mounted onto the air steering ring of the rotary atomizer and protrudes in axial direction into the annular gap of the bell cup without touching the bell cup. In this case, the bushing-shaped shaft cover forms a kind of labyrinth, sealing together with the annular gap that serves for external rinsing, by which penetration of cleaning fluid or coating material into the annular gap between bell cup and air steering ring is counteracted effectively.

The present invention can be used, for example, in a rotary atomizer in which the air steering stream is delivered in axial direction, as known for example from DE 94 19 641 U1. Furthermore, the invention is adequate for rotary atomizers in which the air steering stream is delivered obliquely to the axis of gyration of the bell cup or even in radial direction, in which last case the "Coanda effect" is taken advantage of, as known, for example, from German Patent DE 100 53 296 C2. Therefore, the contents of this publication must be accounted to the present description to its fullest extent, as to the constructive design of a rotary atomizer with a radial delivery of steering air.

Furthermore, the rotary atomizer according to the present invention also offers the possibility of loading the sprayed coating material electrically, as already known. The electric charge of the coating material can be carried our, for example, by means of external electrodes that protrude obliquely from the atomizer casing towards the front. However, there exists alternatively also the possibility of charging the coating material by means of electrodes integrated into the bell cup. For this purpose, for example, a front electrode can be mounted that protrudes from the front side of the bell cup. Another possibility of charging the coating material electrically consists of using a canal electrode that points into the coating material canal inside the bell cup. Furthermore the possibility exists of electrically charging the air steering ring or air steering jets.

Furthermore, the present invention not only concerns such a rotary atomizer according to the invention, but also a complete coating installation, as, for example, a paint robot with such a rotary atomizer. The present invention is not limited to wet paint rotary atomizers, but is also applicable to powder rotary atomizers. The present invention also includes the innovative use of a bushing as shaft cover for covering a bearing shaft in an annular gap between a rotary atomizer and a bearing shaft mounted on a bell cup.

Finally, the present invention concerns also an innovative cleaning procedure for the rotary atomizer according to the invention, which for the first time makes possible an automatic cleaning in an automatic cleaning installation due to the bushing-shaped shaft cover, as known, for example, from European Patents EP 0 333 040 B1 and EP 1 367 302 A2. The content of these two publications is to be taken into account by the present description as to automatic cleaning to its full extent.

Accordingly, one embodiment of the present invention provides a rotary atomizer component, such as a steering air ring or bell cup, for a rotary atomizer with at least one steering air jet for delivering a steering air stream and a rotary bearing shaft. A circumferential annular gap is located in an axial direction between the bell cup and the steering. A shaft cover covers the bearing shaft when mounted at least partially in the annular gap area between the bell cup and the steering air jet.

Another embodiment of the invention provides a rotary atomizer where the annular gap space between the front surface of the bearing unit and the internal surface facing it axially, or any other front element of the atomizer is sealed in a radial way internally against the externally accessible area of the shaft. Preferably the sealing element provided for this purpose is located along the internal circumference of the air-steering rings or front element and able to be attached to the front surface of the bearing unit in a way that it is elastically deformable.

Still another embodiment of the invention provides a rotary atomizer where the annular gap space between the front surface of the bearing unit and the internal surface facing it axially, or any other front element of the atomizer is sealed in a radial way internally against the externally accessible area of the shaft. Preferably the sealing element provided for this purpose is located along the internal circumference of the air-steering rings or front element and able to be attached to the front surface of the bearing unit in a way that it is elastically deformable.

The invention makes possible the spraying of rotary atomizers during automatic cleaning (directly in the bearing shaft area with cleaning fluid) without the annular gap space between bearing unit and air-steering ring or any other front element of the atomizer being filled with liquid that would be blown out of the atomizer or flow out of it in another manner, thereby affecting the coating. Within the scope of this invention, this annular gap space could be limited at its backside facing away from the front element by any other radial front surface of the atomizer's internal structure instead of the shaft bearing unit. Even during coating operation affecting media or particles may penetrate the annular gap space from outside.

Accordingly, in yet another embodiment of the present invention, the rotary atomizer component is an air-steering ring forming the atomizer's front element. The sealing element forms a ring-shaped sealing lip can be located along its internal circumference thus forming the internal circumference or being located only in its proximity. This sealing element can be linked to an atomizer component such as the air-steering ring or any other front element, in one piece or in a way of being replaced. The capability replacing the sensitive sealing element can be practical in view of possible damages or wear and tear. The sealing element can consist of a sufficiently elastically deformable plastic material for its purpose, of which also consists the front element in the case of one piece, while in that of two pieces, the front element itself may consist of plastic or, for example, of metal. The sealing element my be integrated or, in a given case, fixed in a way so that it can be replaced, to any other part of the atomizer's casing instead of the air-steering ring or any front element. The sealing element may be also mounted onto the atomizer also as a completely separate component. In the case of an air-steering ring provided with a sealing element, the former be part of the rotary atomizer's casing as happens with properly known rotary atomizers. Instead of this it can also be formed as a separate component and possess, for example, an external thread by means of which it can be screwed onto an internal thread of the atomizer's casing or any other component of it.

In another embodiment of the of the invention the sealing element seals at least the major part of the annular gap space between the front surface of the bearing unit and the atomizer's front element radially inwards against the shaft, that is, against the area of the shaft between the bearing unit and the bell cup, accessible for media from the atomizer's environment and, therefore, not sealed. Sealing of this annular gap space against the shaft's externally accessible area can take place under axial deformation of the sealing element between the radial surfaces of the annular gap space without the sealing element have to adhere to the shaft. However, examples of the invention are possible, in which the sealing lip or any other sealing element adheres to the shaft itself. The sealing is practically formed and located so that it is pressed against its contact area by an especially liquid medium penetrating the atomizer from the outside, in the examples mentioned, against the bearing unit or the shaft.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

Figure 1:
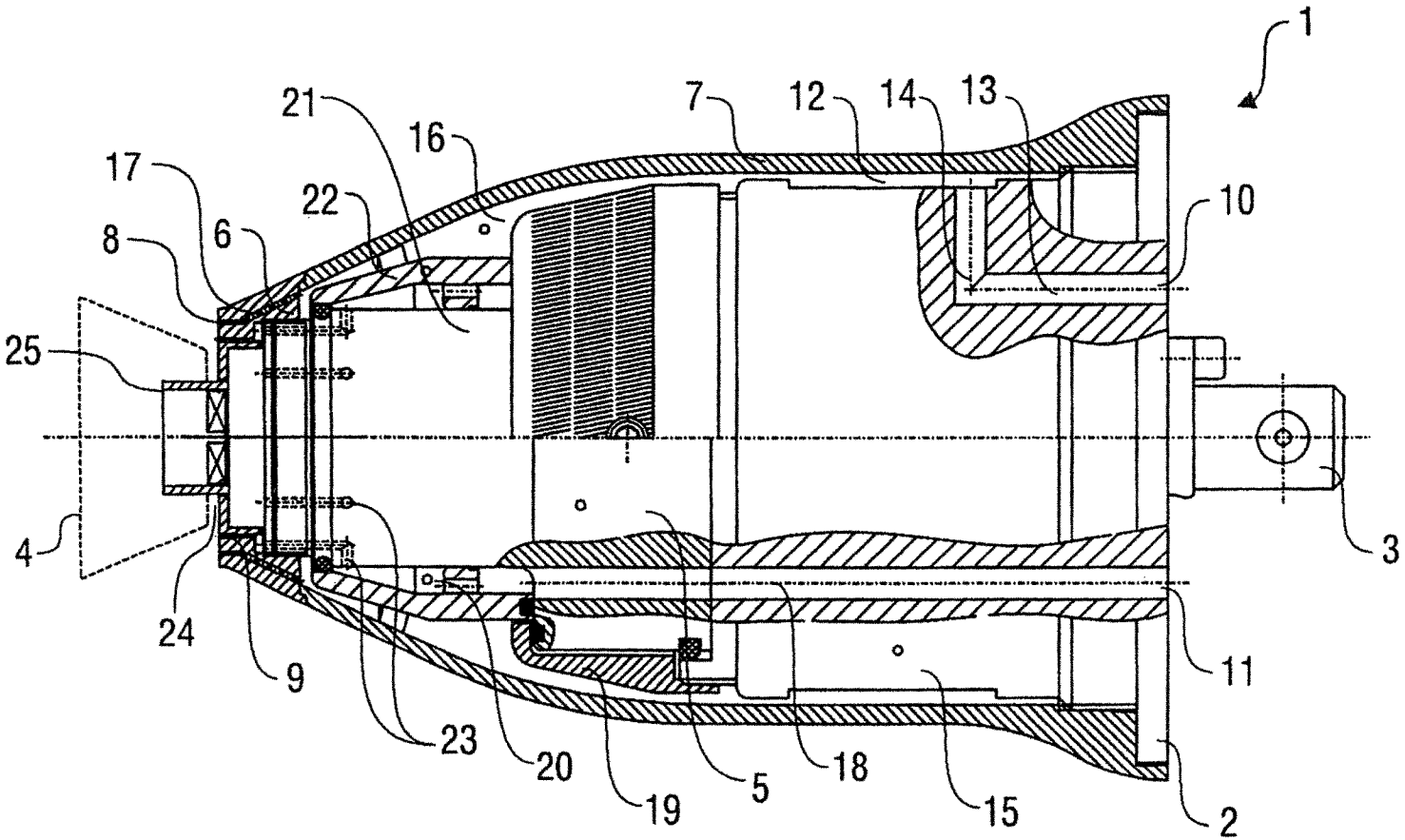
FIG. 1 shows a partial cross sectional view of a high rotary atomizer to which the embodiments of present invention can be applied.

The rotary atomizer 1 shown in FIG. 1 shows on its mounting front area a mounting flange 2 with a mounting pivot 3 thus permitting mechanical mounting on a robot arm of a paint robot. Mounting of a rotary atomizer (such as rotary atomizer 1) on a robot arm is described in German Patent DE 43 06 800 A1, so that the contents of this publication can be accounted to the present description as to mounting rotary atomizer 1 on the robot arm to its fullest extent.

A conventional bell cup 4 can be mounted on the rotary atomizer 1, which, during operation of rotary atomizer 1, is powered via bearing shaft 26 supported by bearing unit 5 by a high-speed compressor turbine (not shown). Revolving the bell cup 4 leads in this case to accelerating the coating material injected into the interior of bell cup 4 axially and especially in a radial way, being sprayed on an edge of the bell cup.

The compressor turbine is powered by compressed air supplied from the paint robot over the mounting flange 2. The air power supply is not shown for the sake of simplification. Bearing unit 5 is mounted by ring 19 onto the rotary atomizer 1.

An air steering ring 6 is mounted on the front of casing 7 of the rotary atomizer 1 opposing the bell cup to form the spray stream delivered by bell cup 4. In the air steering ring 6 there are several axially directed air steering jets 8 and 9 which are located in ring form, through which the steering air stream can be blown externally onto the conical generated surface of bell cup 4. Depending on the amount and speed of the steering air ejected from the air steering jets 8, 9 the spray stream is formed and the desired stream width is adjusted.

Steering air supply for the two air steering jets 8, 9 flows through flange openings 10, 11, located on mounting flange 2 of the rotary atomizer 1. The position of flange openings 10, 11 within the front area of mounting flange 2 is in this case given by the position of the corresponding connections to the pertinent mounting flange of the paint robot.

The external air steering jets 8 are supplied conventionally by an air steering line 12 which is located on the external side of bearing unit 5 between casing 7 and bearing unit 5. For this purpose, flange opening 10 enters first into axial branch bore 13 that continues into radial branch bore 14, ending finally on the external side of valve casing 15 in an intermediate space between casing 7 and valve casing 15. The steering air flows past the bearing unit 5 into the air space 16, from where it flows through a branch boring 17 in the air steering ring 6 to the air steering jets 8, 9.

Steering air supply for the internal air steering jets 9 disposed in ring flows through a steering air conduit 18, which passes from flange opening 11, parting from support flange 2, axially and free from buckling through valve casing 15. Furthermore, steering air conduit 18 also goes axially through bearing unit 5 of the compressor turbine. The radial distance of steering air conduit 18 from the rotation axis of bell cup 4 is in this case bigger than the external diameter of the turbine wheel (not shown for the sake of simplification), so that steering air conduit 18 runs along the outer surface of the turbine wheel. The steering air conduit 18 ends on the side of the bell cup in another air space 20, located between an essentially cylindrical section 21 of the compressor turbine bearing unit 5 and a cover 22 surrounding it.

In the generated surface of section 21, several bores 23 are located that end at the front surface of compressor turbine bearing unit 5 facing the bell cup 4, reaching finally the air steering jets 9. Bores 23 of section 21 of bearing unit 5 each consist of a radial branch bore parting from the generated surface of section 21 and an axial bore parting from section 21 facing the bell cup, making thus a simple mixture possible.

The diameter of casing 7 of the rotary atomizer 1 is not increased by additional steering air conduit 18 and the space available for the compressor turbine is not increased by steering air conduit 18. This is advantageous in the presently described layout. A further advantage of steering air conduit 18 according to the present invention is the buckling-free trajectory of the steering air stream, which is optimized as to fluid dynamics.

A circumferential annular gap 24 is located between bell cup 4 and air steering ring 6. Circumferential annular gap's 24 bottoms is formed by bushing-shaped shaft cover 25 which in turn is connected to the air-steering ring 6 in one piece and adjusted coaxially towards the rotation axis of bell cup 4.

The bushing-shaped shaft cover 25 makes possible, in an advantageous manner, the automatic cleaning of the rotary atomizer 1 in an automatic cleaning installation, as shown, for example, in European Patents EP 0 333 040 B1 and EP 1 367 302 A2. When cleaning rotary atomizer 1 (with mounted bell cup 4) in an automatic cleaning apparatus, the bushing-shaped shaft cover 25 prevents penetration of cleaning fluid into the annular gap 24 between bell cup 4 and air-steering ring 6. Such remnants of cleaning fluid in annular gap 24 could lead to contamination by splatters of cleaning fluid of the specimens to be coated in a subsequent coating operation. Furthermore, the bushing-shaped shaft cover 25 addresses the cause of such contamination, namely the vacuum caused in annular gap 24 by blowing the steering air out. This is achieved by the fact that bushing-shaped shaft cover 25 reduces the free width of annular gap 24 in radial direction, which leads to the corresponding reduction of the vacuum in annular gap 24.

Figure 8:
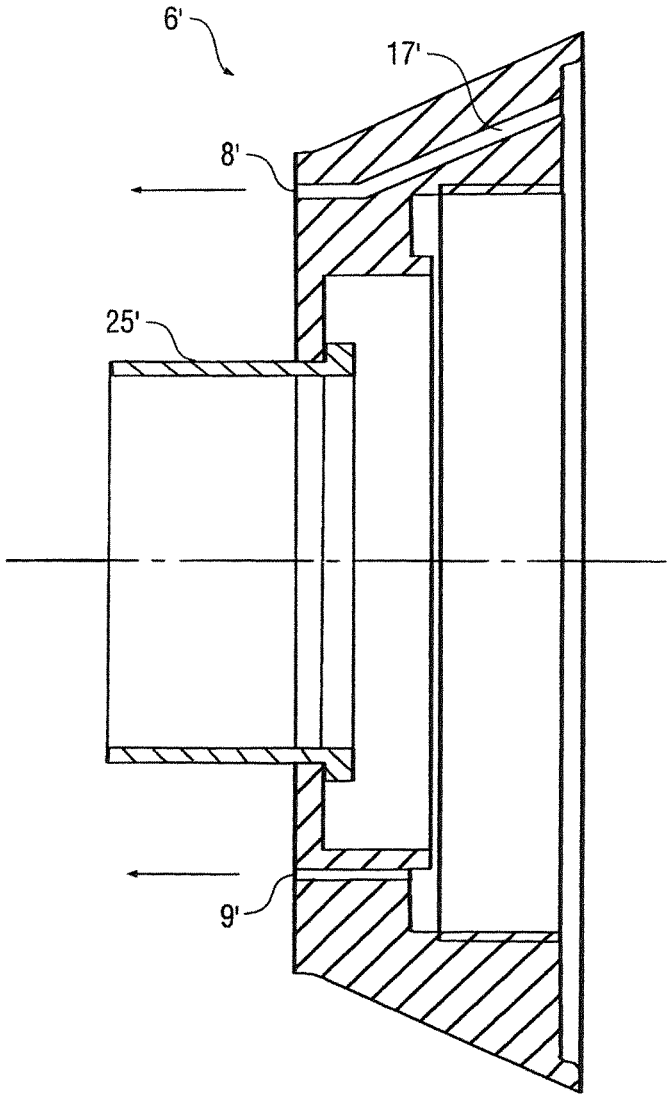
FIG. 8 shows a transversal cross section of an air steering ring according to another embodiment of the present invention.

FIG. 8 shows an alternative example of air-steering ring 6' according to another embodiment of the present invention that coincides mostly with the example described before and illustrated by FIGS. 1 to 4 of air-steering ring 6. To avoid repetition this application refers to the present description which used the same reference symbols but marked with an apostrophe for differentiation.

A feature of this embodiment is that the bushing-shaped shaft cover 25' is not connected to air steering ring 6' but forms a separate component. For mounting, bushing-shaped shaft cover 25' is pressed into a bore in air steering ring 6', so that bushing-shaped shaft cover 25' is then linked by a drive fit to air steering ring 6'.

The design of the bushing-shaped shaft cover 25' as a separate component makes it possible to make the bushing-shaped shaft cover 25' and the air steering ring 6' out of different materials, thus making a constructive optimization of each one of the components according to their technical function possible. For example, the bushing-shaped shaft cover 25' is made of plastic but it may be made of different materials (metals, composite materials, etc) depending upon need.

Figure 9:
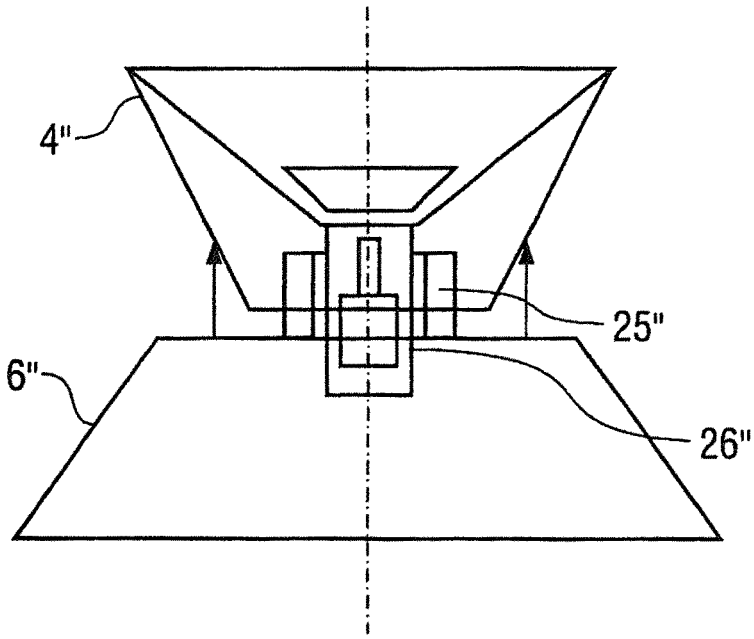
FIG. 9 shows a simplified schematic representation of one embodiment of the present invention.

The schematic representation in FIG. 9 clarifies the principle of the invention without entering into constructive details. Therefore, for avoiding repetitions this application refers again to the present description and uses the same reference symbols, marked with two apostrophes for differentiation. FIG. 9 shows bearing shaft 26" surrounded by shaft cover 25" like a bushing. The shaft cover 25" protects the bearing shaft 26" from contamination.

Figure 10:
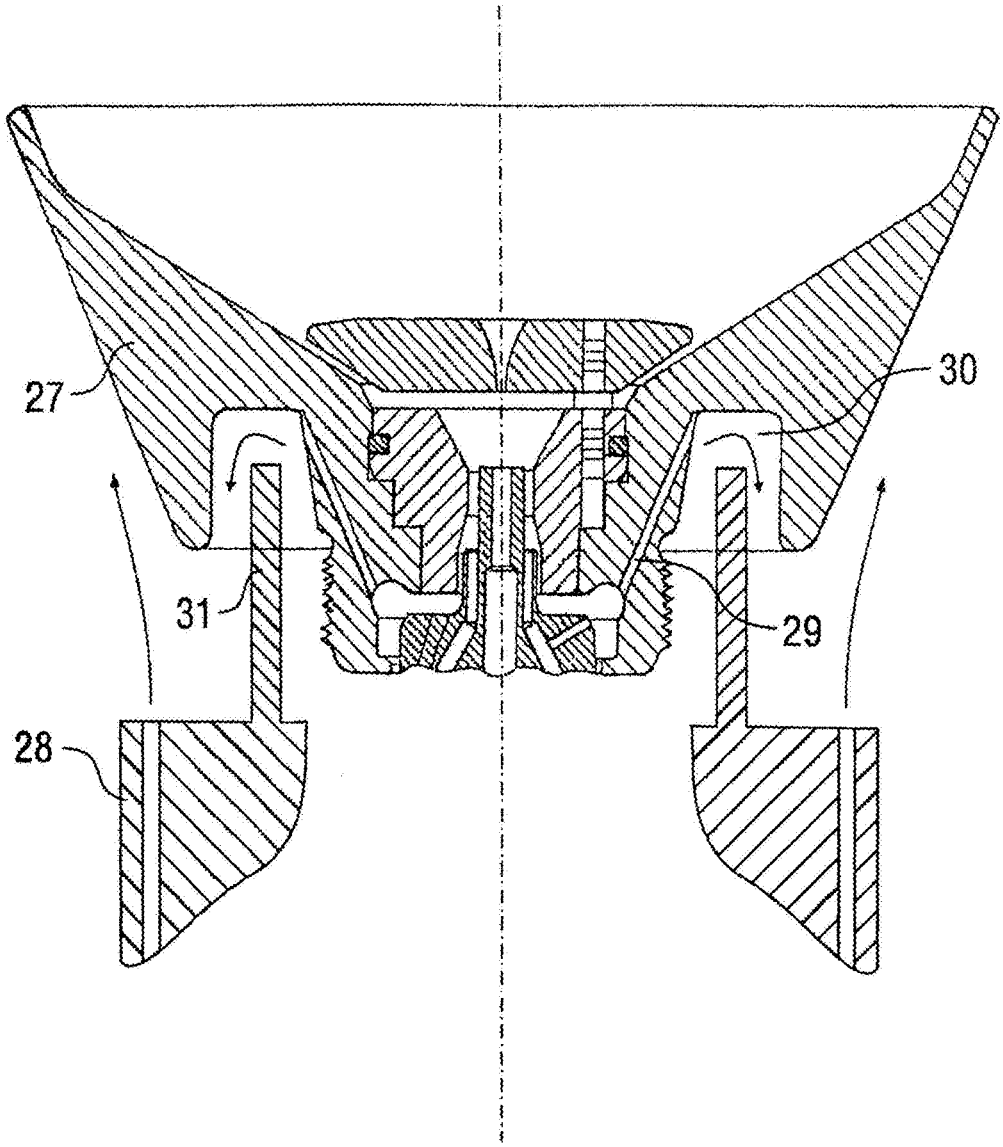
FIG. 10 shows a transversal section of a bell cup with external rinsing in connection with an air steering ring according to the invention.

Finally, FIG. 10 shows a transversal section of bell cup 27 and air-steering ring 28, as shown generally by the already quoted publication DE 94 19 641 U1. As to constructive details and function this application refers to said publication, while only the features of this example according to the invention are explained hereinafter.

Bell cup 27 has external rinsing channels 29 for external rinsing of bell cup 27 which end in annular gap 30, located on the side facing this air-steering ring 28 of bell cup 27. This makes a conventional rinsing possible.

A bushing-shaped shaft cover 31 is fitted in one piece on the front surface facing bell cup 27 of air-steering ring 28. The shaft cover 31 protrudes axially into annular gap 30. Thus the bushing-shaped shaft cover 31 forms a kind of labyrinth sealing together with the annular gap 30, by which penetration of cleaning fluid or coating material is counteracted effectively In rotary atomizers of the type as shown, a radial annular gap forms ring or annular gap space 43 open towards shaft 43 between the radial ring-shaped front surface 41 of bearing unit 5 and its axial parallel ring-shaped opposed inner surface 42 of air steering ring 6. The present invention can be applied also to the examples described in German Patent Application DE 10 2005 015 604 (previously mentioned). In contrast to atomizers described in said patent application, the present invention differs due to the special design of air steering ring 6.

Figure 2:
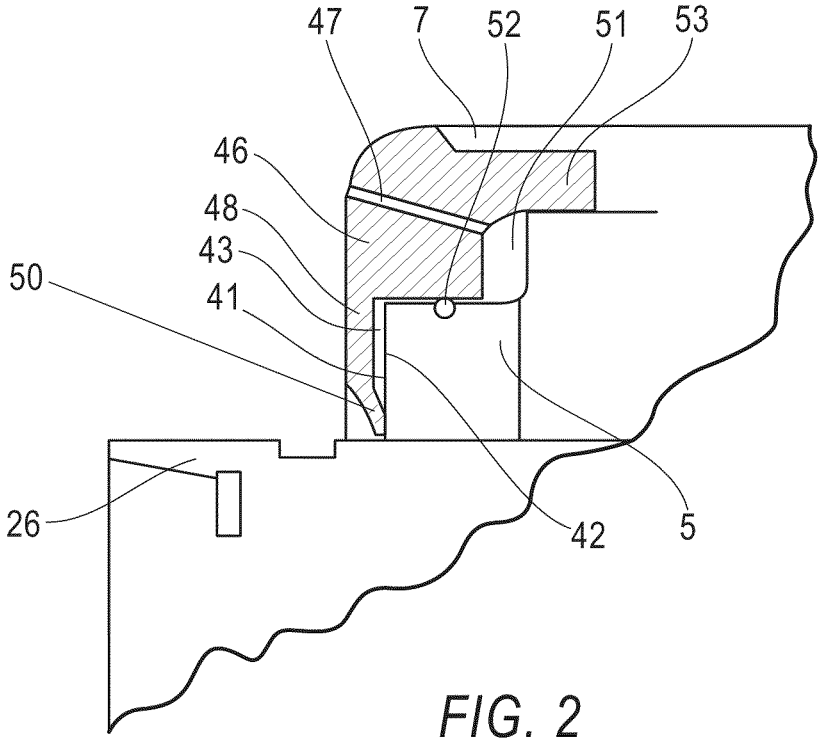
FIG. 2 shows a schematically simplified cross-sectional detail showing the location of an air-steering ring provided with a sealing lip according to one embodiment of the present invention in a high rotary atomizer.

FIG. 2 shows an example of an embodiment of the present invention with an air steering ring 46 designed according to the present invention. Shaft 26 is supported by bearing unit 5, for example, conventionally a hollow shaft, into whose front end the bell cup (not shown) can be screwed or mounted in any other manner. According to the invention, air steering ring 46, shown in section, has a different form than would a prior art ring, especially, the relatively flat and ring-shaped bridge element 48, which continues into a ring-shaped sealing lip at the diameter of shaft 26, forming a front element of the atomizer radial towards the interior. In the embodiment shown, sealing lip 50 can end at its radial innermost end before shaft 26 without touching it.

Sealing lip 50 is bent off slightly across from radially connecting outward bridge part 48 in an axial direction opposed to the bell cup, i.e., axially against bearing unit 5, if air steering ring 46 is not inside the atomizer. If air steering ring 46 is mounted, the axial end of the sealing lip 50 protrudes by a practical amount (in case of currently common rotary atomizers approximately. 0.5 to 1 mm) across inner surface 42 and deforms elastically, pressing against front surface 41 of bearing unit 5. In this way, annular gap space 43 formed between front surface 41 of bearing unit 5 and parallel opposite inner surface 42 of bridge element 48 and said bordering inner surface of sealing lip 50 is sealed radial inwardly against the neighboring circumferential area of shaft 26. Annular gap space 43 can, according to the drawing, continue at its radial outer end in axial direction inwards at the circumference of bearing unit 5 up to o-ring 52 for sealing against air-steering space 51. Sealing lip 50 and the total air steering ring 46 are preferably one piece and formed from an elastic plastic such as PTFE. At its collar part 53 stretching inwardly, air-steering ring 46 can be provided with an external thread by means of which it can be screwed into the internal thread of casing 7.

Figure 3:
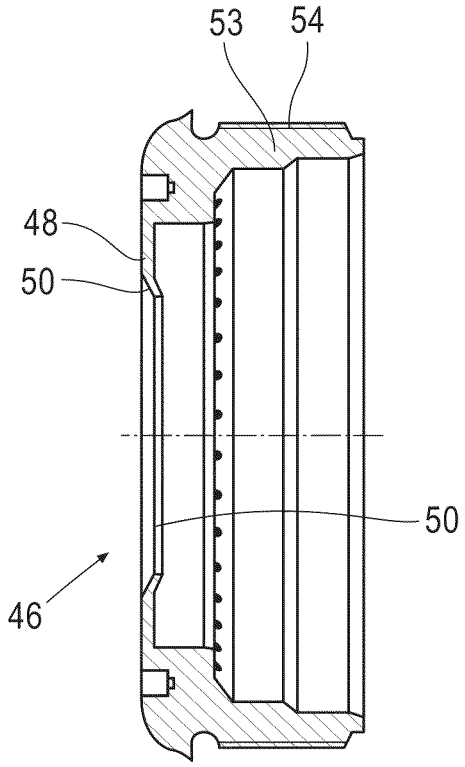
FIG. 3 shows an air-steering ring built in practice according to one embodiment of the present invention.

FIG. 3 shows an example of air-steering ring 46. In this example there is a ring element with an external diameter of approximately 56 mm in which the radial innermost end of sealing lip 50 protrudes approximately 0.7 mm against inner surface 42 of bridge element 48. The above-mentioned external thread of collar element 53 is visible at 54.

Figure 4:
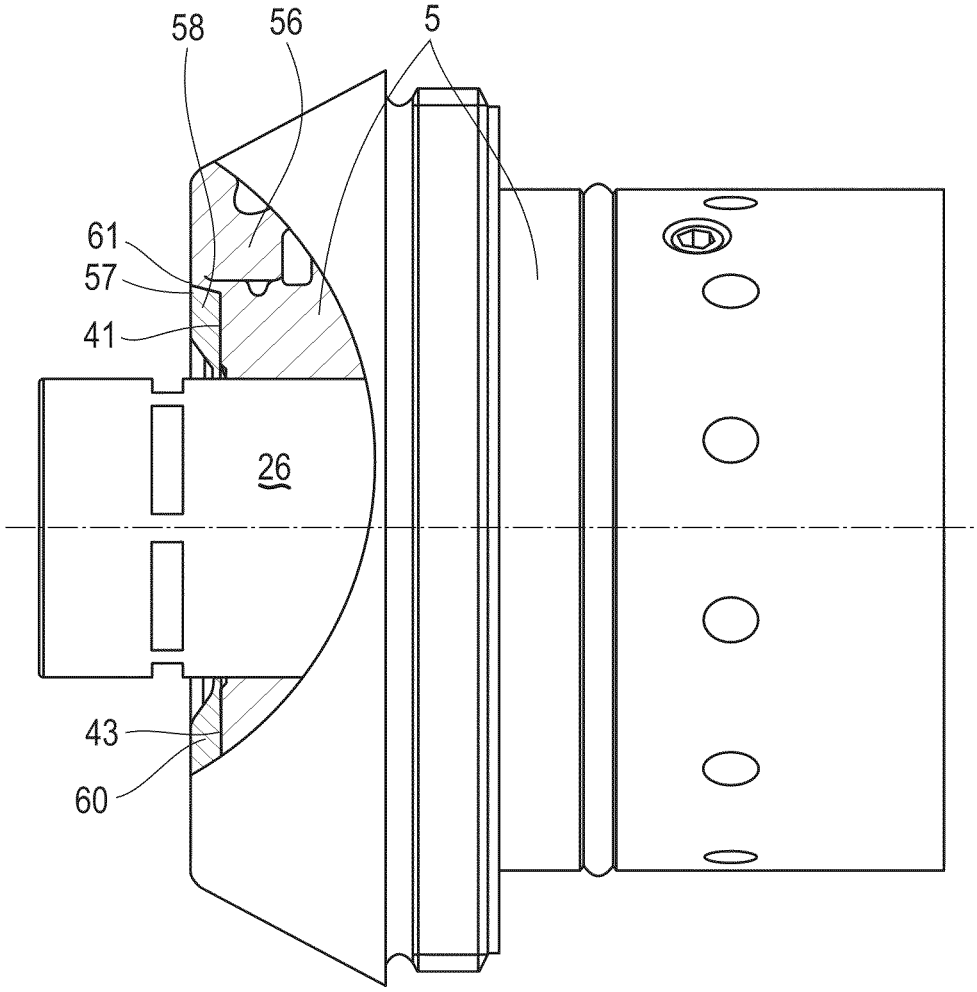
FIG. 4 shows the front die construction of a high rotary atomizer according to another embodiment of the invention.

FIG. 4 shows as another example of the present invention. This example shows bearing unit 5 for shaft 26 of a high rotary atomizer with air-steering ring 56 onto whose interior diameter sealing lip 60 is not connected in one piece as in FIG. 3 but as a separate, preferably interchangeable, sealing element. In this example, sealing lip 60 consists of a ring element of plastic with a rectangular recess provided at the radial external end on the side facing the bell cup. Border element 57 is formed as to fit thereto, forming the interior circumference of air-steering ring 56, preferably snapping into it without gaps in such a way that the axial external front surfaces of the air-steering ring 56 and the sealing lip align with each other. Border element 61, at the exterior diameter of sealing lip 60, snaps into ring groove 58, which, according to the drawing, is located inside the internal circumference of air-steering ring 56 at the radial external end of border element 57. For replacing, sealing lip 60 can be squeezed out of ring groove 58 due to the plastic's elasticity, while a new sealing lip can be squeezed in as simply. Alternatively, the sealing lip 60 could also be mounted tightly to air-steering ring 56, for example, by being glued to it.

The design of separate sealing lip 60 may, at its internal diameter, include the bend off in axial direction against front surface 41 of bearing unit 5 (corresponding to the examples of FIGS. 2 and 3) so that in the example shown in FIG. 4 the already described annular gap space 43 is sealed reliably inwards towards shaft 26. Air-steering ring 56 itself can be made, in this example, of any other plastic or, especially, also of metal.

Figure 5:
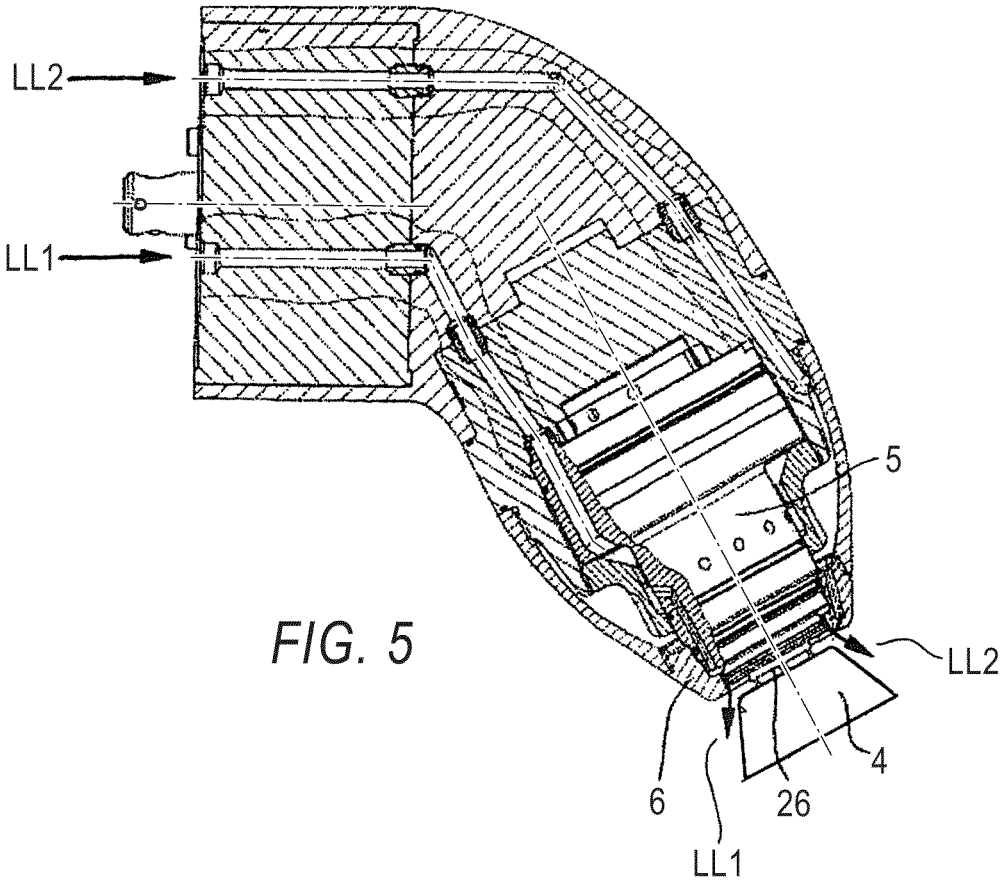
FIG. 5 shows a cross sectional view of another high rotary atomizer, to which the embodiments of present invention can be applied.
Figure 6:
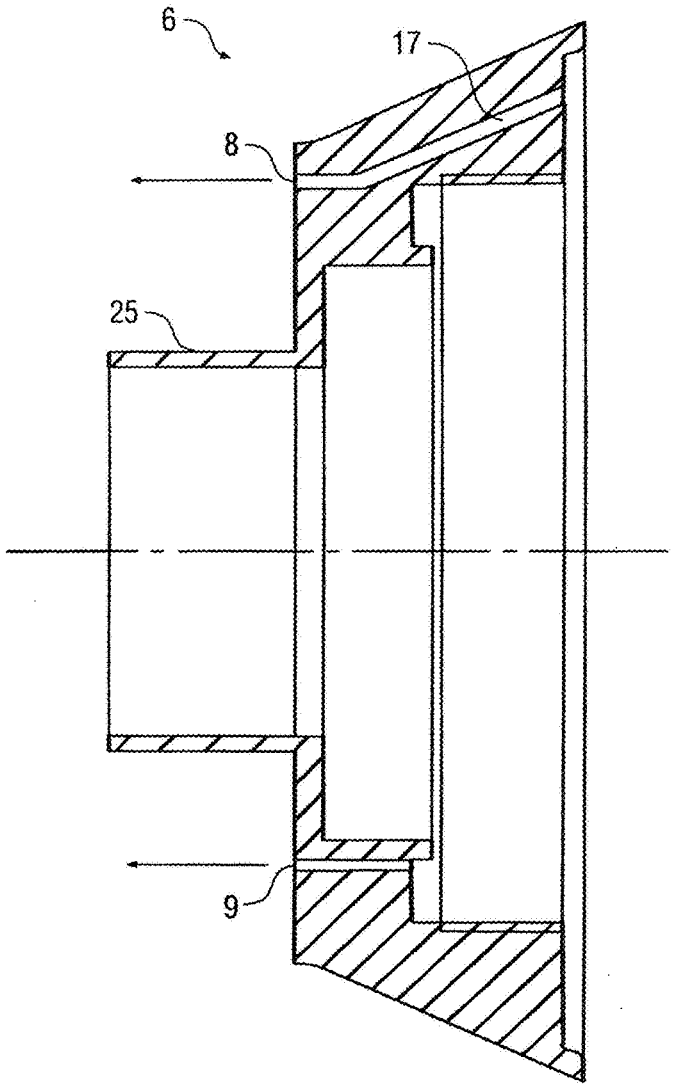
FIG. 6 shows a transversal cross section of an air steering ring according to one embodiment of the present invention.
Figure 7:
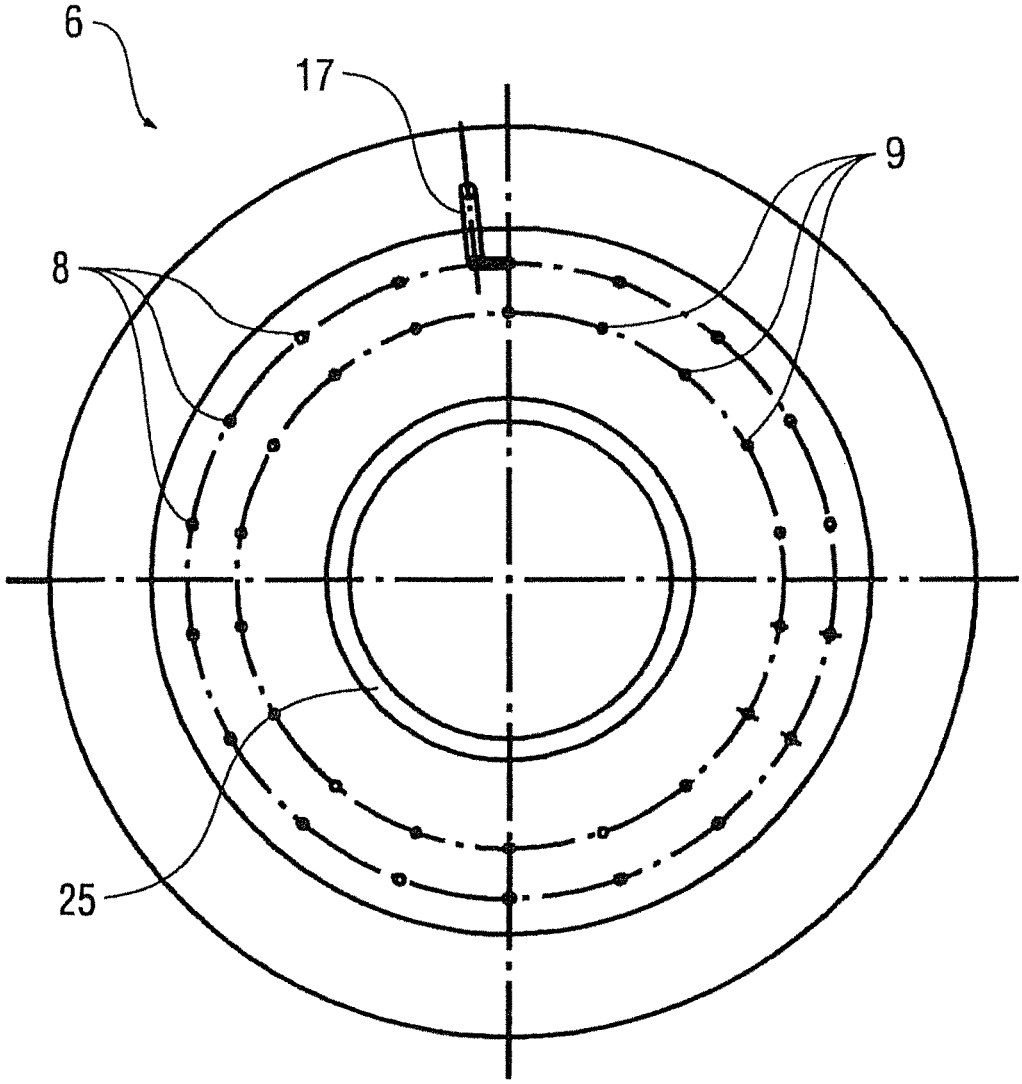
FIG. 7 shows a frontal elevation of the air steering ring shown in FIG. 6.

In FIG. 5 a high rotary atomizer is shown that differs from the atomizer of FIG. 1, as well as from conventional high rotary atomizer, because it lacks the bushing or collar-shaped shaft cover 25. Especially bell cup 4, shaft 26, bearing unit 5 and air-steering ring 6 (through which compressed air escapes at LL1 and LL2, according to the arrows shown on bell cup 4) correspond to an atomizer according to FIG. 1, so no further description is necessary. Also in this properly conventional atomizer, air-steering ring 6 can be designed according to the invention as described. Since here said shaft cover 25 is missing, the danger of penetration of external cleaning or other media or particles into the annular gap space between bearing unit 5 and air-steering ring 6 is greater that in the case of the atomizer according to FIG. 1. For example, at rotating bell cup 4 during operation different undesired particles may be sucked in from the area of the atomizer into the shaft area by the bell cup 4 due to a vacuum at shaft 26 and vortices caused thereby. However, this is avoided by means of the sealing element according to the invention that they reach said annular gap space. Since shaft cover 25 is missing, it is, furthermore, especially important in this form of design of the atomizer, that in the case of direct spraying of the shaft area with cleaning fluids, these should not be able to penetrate the area between air-steering ring 6 and bearing unit 5.

What is claimed is:

1. A rotary atomizer component for a rotary atomizer, the rotary atomizer having an atomizer casing, the rotary atomizer having a bell cup mounted on a rotary bearing shaft, the rotary bearing shaft having a bearing unit, and an area between the bearing unit and the shaft is accessible for media from the surroundings of the atomizer, the rotary atomizer component comprising a sealing element surrounding the shaft in a form of a ring that seals at least part of an annular gap located between a front surface of the bearing unit and a bridge element that extends from the sealing element toward the shaft, wherein the sealing element is deformable in an axial direction and protrudes towards the front surface of the bearing unit in the axial direction.

2. A rotary atomizer component according to claim 1 wherein the sealing element includes a ring-shaped sealing lip extending from the bridge element.

3. A rotary atomizer component according to claim 2 wherein the sealing lip ends at a radial innermost end proximate to but not touching the shaft.

4. A rotary atomizer component according to claim 2 wherein the sealing lip is bent from the bridge element in an axial direction toward the bearing unit.

5. A rotary atomizer component according to claim 2 wherein the sealing lip deforms elastically and is pressed against the front surface of the bearing unit.

6. A rotary atomizer component according to claim 1 wherein the sealing element is joined or fixed to the rotary atomizer in one piece.

7. A rotary atomizer component according to claim 1 wherein the sealing element is fixed to the rotary atomizer so that it can be replaced.

8. A rotary atomizer component according to claim 7 wherein the sealing element is fixed along the internal circumference of the front element by means of a detachable snap-on joint.

9. A rotary atomizer component according to claim 1 wherein the sealing element is located along the internal circumference of the front surface.

10. A rotary atomizer component according to claim 1 wherein the sealing element is a separate component and joined mechanically with the rotary atomizer.

11. A rotary atomizer component according to claim 1 wherein the sealing element is made of a material that is softer than the bearing shaft.

12. A rotary atomizer component according to claim 1 wherein the sealing element that is joined to a component of the rotary atomizer is made of a material selected from the group consisting of plastic or metal or combinations thereof.

13. A rotary atomizer component according to claim 1 wherein an air-steering ring is formed into a front element.

14. A rotary atomizer component according to claim 13 wherein the air-steering ring has a thread for screwing onto an internal part of the atomizer.

15. A rotary atomizer component according to claim 1 wherein a front element has a thread for screwing onto an internal part of the atomizer.

16. A rotary atomizer having an atomizer casing, a bell cup mounted on a rotary bearing shaft, the rotary bearing shaft having a bearing unit, an area between the bearing unit and the shaft is accessible for media from the surroundings of the atomizer, and a rotary atomizer component comprising a sealing element surrounding the shaft in a form of a ring that seals at least part of an annular gap located between a front surface of the bearing unit and a bridge element that extends from the sealing element toward the shaft, wherein the sealing element is deformable in an axial direction and protrudes towards the front surface of the bearing unit in the axial direction.

17. A method for a coating installation using a paint robot with a rotary atomizer, the method comprising using an atomizer casing, a bell cup mounted on a rotary bearing shaft, the rotary bearing shaft having a bearing unit, and an area between the bearing unit and the shaft is accessible for media from the surroundings of the atomizer, and a rotary atomizer component comprising a sealing element surrounding the shaft in a form of a ring that seals at least part of an annular gap located between a front surface of the bearing unit and a bridge element that extends from the sealing element toward the shaft, wherein the sealing element is deformable in an axial direction and protrudes towards the front surface of the bearing unit in the axial direction.

18. A method for cleaning a rotary atomizer having an atomizer casing, the method comprising using a bell cup mounted on a rotary bearing shaft, the rotary bearing shaft having a bearing unit, and an area between the bearing unit and the shaft is accessible for media from the surroundings of the atomizer, a rotary atomizer component comprising a sealing element surrounding the shaft in a form of a ring that seals at least part of an annular gap located between the front surface of the bearing unit and a bridge element that extends from the sealing element toward the shaft, wherein the sealing element is deformable in an axial direction and protrudes towards the front surface of the bearing unit in the axial direction, and spraying the rotary atomizer with a cleaning fluid for cleaning.

19. The method for cleaning a rotary atomizer according to claim 18 wherein the rotary atomizer is also sprayed with cleaning fluid in the area of the shaft cover.

20. The method for cleaning a rotary atomizer according to claim 18 wherein the rotary atomizer is introduced into a cleaning installation for cleaning and is sprayed with the cleaning fluid while inside the cleaning installation.

* * * * *